US005533810A

United States Patent [19]

Jensen

[11] Patent Number: 5,533,810

[45] Date of Patent: Jul. 9, 1996

[54] DOCUMENT CARRIER

[76] Inventor: Daniel L. Jensen, 3751 Norris Canyon Rd., San Ramon, Calif. 94583

[21] Appl. No.: 272,671

[22] Filed: Jul. 7, 1994

[51] Int. Cl.[6] ..... B65D 33/04

[52] U.S. Cl. ..... 383/66; 383/106; 229/71; 229/301

[58] Field of Search ..... 229/69, 71, 301, 229/303; 383/66, 106

[56] References Cited

U.S. PATENT DOCUMENTS

| | | | |
|---|---|---|---|
| 1,424,356 | 8/1922 | Healy | 229/71 X |
| 2,251,930 | 8/1941 | Gray | 229/71 X |
| 2,921,731 | 1/1960 | Volckening et al. | 383/66 X |
| 3,140,816 | 7/1964 | Schultz | 229/69 |
| 3,150,473 | 9/1964 | Lemelson | 229/71 X |
| 3,899,127 | 8/1975 | Melander | 229/303 |
| 4,951,863 | 8/1990 | Templet | 229/301 X |

FOREIGN PATENT DOCUMENTS

| | | | |
|---|---|---|---|
| 4-267749 | 9/1992 | Japan | 383/106 |

*Primary Examiner*—Jes F. Pascua
*Attorney, Agent, or Firm*—Donald R. Boys

[57] ABSTRACT

A document carrier formed as an enclosure of two layers has substantially opaque regions for insuring privacy of any documents within, and at least one transparent region for displaying routing information on any documents within the carrier. In one embodiment there are transparent regions on each side, with each side annotated by means of color, written material, or pattern, to indicate an assignable purpose, allowing a user to select a characteristic for routing a document by whether the routing information is visible through one side or the other side. Different construction methods and uses are disclosed, such as an embodiment dedicated to routing facsimile messages.

19 Claims, 9 Drawing Sheets

DOCUMENT CARRIER

FIELD OF THE INVENTION

This invention is in the area of office equipment generally, and relates more particularly to carriers for routing documents in a business environment. The invention has particular application to routing and delivery of facsimile messages.

BACKGROUND OF THE INVENTION

Efficient communication has long been recognized to be important to successful office management. An ability to quickly and efficiently route hard-copy documents is an integral part of efficient communication, and therefore of efficient office management. The need for routing documents has led to the development of several sorts of routing carrier systems.

A desirable characteristic for a routing carrier for hard-copy documents is that the carrier obscure the document or documents transmitted to provide a measure of privacy, a requirement easily met by constructing the carrier of an opaque or semi-opaque material, like relatively heavy paper or light cardboard. Perhaps the best known document routing carrier of this type in the art is the familiar kraft paper envelope with a button-and-string closure. Carriers of this sort have been in use in office environments for many years.

The need for privacy, however, leads to a common problem for such routing carriers, that the name and location of the intended recipient of the document or documents is hidden as well. That is, if a memo or letter has an address or other routing information on the cover or first page, the address will not be seen once the document is placed in the carrier.

The conventional solution for the problem of obliterating any routing information by placing a document in a substantially opaque carrier, is to provide space on an outside surface of the carrier for an address or other routing information. Typically one or both sides of such a carrier will have sequential columns of lines upon which one is expected to write routing for the carrier. Frequently there will be more than one column, depending on the building and departmental structure of an organization. For example, there may be in one row, a position for a person's name, another for a building or plant no., and another for a department.

There are several distinct problems that arise from having routing address positions on a carrier. One is that the space for addressing positions is limited to the area of the sides of the carrier, such as the front and the back of manila envelope. This characteristic severely limits the useful life of the carrier. When one has used the last address space, the carrier is no longer usable, and is typically discarded. Although such carriers are not individually expensive, providing large numbers for a relatively large organization, in view of early obsolescence, can be quite costly.

Another problem with conventional carriers is that it is desirable in many environments to provide other indicia on a carrier than the routing information. For example, an organization might wish to have easily distinguishable carriers for different purposes. There might be one set for "secret" messages, another for highest priority messages, and a third for lower priority. The different purposes may be as varied, for example, as the several different kinds of mail provided by the United States Post Office.

The area of a carrier used for indicia other than routing information is not available for routing information, and the life expectancy of such a carrier depends on the number of routing spaces made available. Competition for space, then, may further limit the life of a carrier.

Still another problem with carriers of the sort with address spaces on the outer surfaces of the carrier, is that it takes time to address the carrier.

Inter-office mail, which is the essential nature of the document handling operations described above, is only one sort of document routing and delivery service. Another, and somewhat unique requirement for document carriers in many office environments is in the area of sending and receiving facsimile messages.

In an office involving no more than a few people and a relatively small work area, sending and receiving faxes is a relatively straightforward process. Each worker typically goes to the fax machine and sends and receives his/her own documents, and there is no need for a carrier system. Even in this straightforward atmosphere, however, there are often delays and errors, because there is no particularly recognizable way to discern a received facsimile document or a document to be forwarded by facsimile from a lot of other papers that might be laying about. There is also little privacy afforded by such an unstructured approach.

In more extended office environments, where there are relatively large numbers of workers sharing limited facilities, it is more common for hard-copy fax documents to be routed to a fax facility and handled by a person whose job description includes sending and receiving fax messages. In this kind of environment, it is easy for documents to get misdirected, misplaced, and even lost, unless there is some organized way for documents to be routed.

Fax messages, of course, have some rather unique characteristics, and a carrier system should distinguish. For example, most documents one might wish to send to a relatively remote recipient by fax, carry no distinguishing characteristic identifying the sender's intentions. This is the reason for the well-known fax cover sheet, used by most individuals and organizations that send and receive faxes.

Even with a fax cover sheet, however, a common document carrier, such as that described for inter-office mail, doesn't distinguish whether the enclosed documents are going to a fax or coming from a fax. The distinction is perhaps most important not in transit, but at the fax facility and at the user's desk.

What is clearly needed is a document routing carrier that provides ample space for indicia of various sorts, and is yet not limited in useful life by space for routing information. Such a carrier system should provide for distinguishing according to several types of priorities and purposes, and should, in application to the unique nature of fax documents, provide a clear indication of whether documents enclosed are to be sent by fax or have in fact been received by fax, as well as providing routing information, without limiting the useful life of the carrier.

SUMMARY OF THE INVENTION

In a preferred embodiment of the invention, a document carrier comprises substantially rectangular enclosure of length L and width W, formed of two layers of film-like material, closed around both edges of length L and at least one edge of width W. There is a substantially opaque region on each of the two layers for obscuring information on documents within the carrier, and a transparent region through at least one layer for exposing destination information on a document to be loaded into the document carrier. In an alternative preferred embodiment the two layers are closed around all four edges, and a load/unload slit across substantially the width of one of the two layers is positioned within one quarter of the length L from one end of the enclosure. In other embodiments there may be transparent windows through each of the two layers of a carrier.

In various embodiments opacity is provided in necessary degree by printing on clear plastic used to form the carrier, or by using an opaque or semi-opaque material, such as colored plastic, stiff paper, or cardboard. In a unique aspect of the invention, a fax carrier is provided wherein differing color on each outside surface of the carrier indicates whether the contents are to be delivered to a fax center to be transmitted, or to a recipient from the fax center.

The document carrier in several embodiments of the invention provides several advantages. For example, the carrier is reusable over a long period of time, by virtue of the absence of address spaces on the carrier. It also provides for privacy of information on documents in the carrier, and is quicker and easier to use than prior art systems. It provides, too, in some embodiments, a means of prioritizing delivery of enclosed documents.

DESCRIPTION OF THE PREFERRED EMBODIMENTS

Figure 1A:
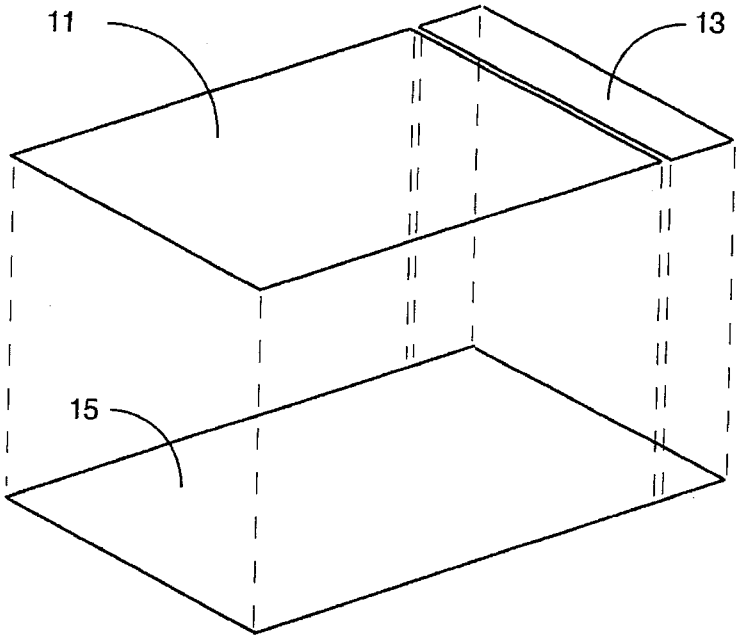
FIG. 1A is an isometric exploded view showing construction details of a document carrier according to an embodiment of the present invention.

FIG. 1A is an isometric view showing construction details of a document carrier according to an embodiment of the present invention. In this embodiment there are three principal regions, a front lower layer region 11, a front upper layer region 13, and a back layer region 15. All three regions are formed of relatively thin and transparent plastic material such as polyethylene. It will be apparent to one with skill in the art that there are a number of suitable materials other than polyethylene.

Figure 1B:
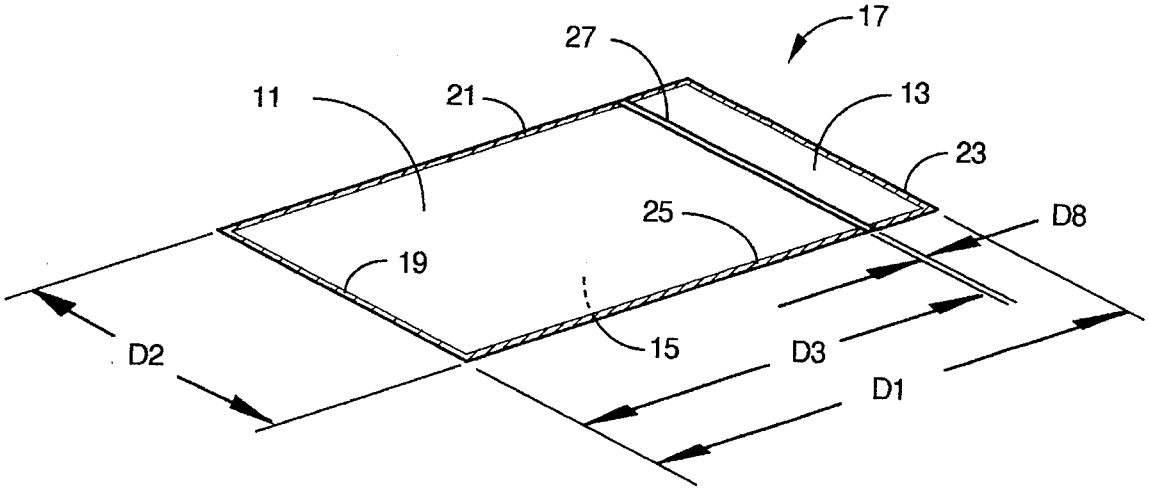
FIG. 1B is an isometric view of the document carrier of FIG. 1A assembled.

Dotted lines shown in FIG. 1A joining the corners of sheets 11, 13, and 15 are intended to show construction relationship in one aspect of the invention. FIG. 1B shows regions 11, 13, and 15 joined to form a document carrier 17. The layers are brought together as indicted by the dotted lines and joined by such as heat sealing along all four outer edges 19, 21, 23, and 25. Heat sealed regions are indicated by shaded areas along the edges. Joining by heat sealing presumes that tile material of the sheets is a material that may be conveniently joined by heat sealing.

In the joining process, a slit 27 is left unsealed between lower front region 11 and upper front region 13. With the layers heat sealed along the edges, as described above, slit 27 is the only entrance/exit access to the interior of document carrier 17. Documents are loaded to the carrier and unloaded from the carrier via slit 27. The side of the carrier with the slit is accordingly called the load/unload side in this specification.

In FIG. 1B, slit 27 is shown as having a particular width D8 in the direction of the length of the document carrier. This width is somewhat arbitrary. Such a load/unload slit may have a relatively large width D8, such as a quarter of an inch, or no width at all. The slit would even serve if the edges of elements 11 and 13 overlap.

Slit 27, located on one side of the document carrier as shown in FIG. 1B, is convenient as an access opening for loading and unloading documents, and is a preferred characteristic, because the particular location allows a user to load documents through the slit, and then to tuck the top edges into the top pocket of the carrier above the slit. One may tuck the documents in or not, as desired.

In the example shown in Fig. 1B, slit 27 is located from the lower edge at a dimension D3 of about 10.75 inches (27.30 cm). It will be apparent to one with skill in the art that the location of the slit may vary while still providing the convenient characteristic as a load/unload access. In an alternative embodiment, the carrier is sealed on three edges (19, 21, and 25) but not the top edge 23, so documents may be loaded and unloaded through the top edge of the carrier.

In the embodiment shown in FIGS. 1A and 1B, overall length D1 is about 12.75 inches (32.39 cm), and overall width D2 is about 9.75 inches 24.77 cm). This is a convenient size for carrying documents of standard U.S. letter size, which is 8.5 by 11.0 inches. For documents of other sizes, such as legal size and international A4 size, document carriers may be formed of sheets of appropriate sizes.

There are many ways a document carrier of the sort depicted by FIGS. 1A and 1B might be made. In FIG. 1B, separate layers are shown sealed along all four edges, which is a convenient construction under certain manufacturing circumstances, such as forming from two distinct strips material. There are other convenient construction techniques under other circumstances.

Figure 1C:
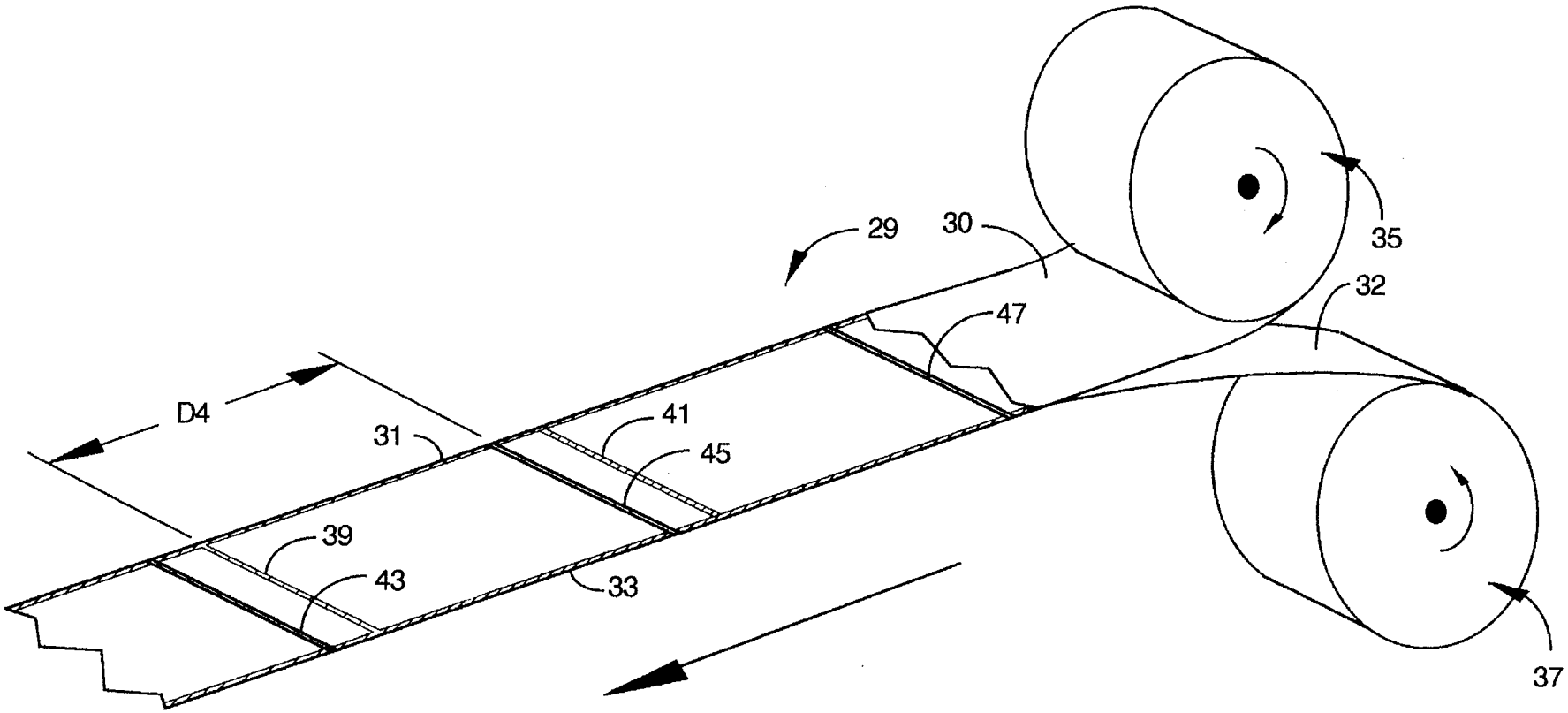
FIG. 1C is an isometric view of a continuous joined strip of two webs sealed together in one stage of a process of making document carriers according to the present invention.

FIG. 1C shows a strip 29 in one stage of a continuous process for forming document carriers such as carrier 17 of FIG. 1B. In this process, two continuous webs 30 and 32 of transparent plastic material are fed by suitable equipment known in the art from two rolls 35 and 37. The two webs are brought into juxtaposition and heat sealed along edges 31 and 33, as indicated by shaded areas along the edges, forming a continuous strip.

After the edges of the two webs are sealed together, cross seals, such as seals 39 and 41 are formed. The cross seals are made at intervals of about 12.75 inches for the document carrier as shown in FIG. 1B. As the sealed web progresses, cutting equipment provides cuts, such as cuts 43, 45, and 47, through only one of the two webs, and again at 12.75 inch intervals, but offset from cross seals such as 39 and 41, such that the distance D4 is 10.75 inches, which is the distance D3 in FIG. 1B.

Once the edge seals, the cross seals, and the cuts, such as cuts 43 and 45, are made, the continuous web may be cut through both layers in the position of the cross seals to separate the continuous web into individual document carriers like document carrier 17 in FIG. 1B. Before separation into individual carriers, edges 31 and 33 may be trimmed, minimizing the width of the sealed areas along the edges. The top and bottom edges may also be trimmed after separation.

The method illustrated with the aid of FIG. 1C is a convenient method. There are other ways plastic sheets may be joined to make the document carrier of FIG. 1B. For example, to make a carrier in the embodiment described above, wherein the upper edge is left unsealed rather than providing a load/unload slit on one side, one would cut the web just adjacent to cross-seals such as 39 and 41, so the resulting carrier would be open at one end. The extra cross-cuts to provide load/unload slits then need not be done.

Figure 1D:
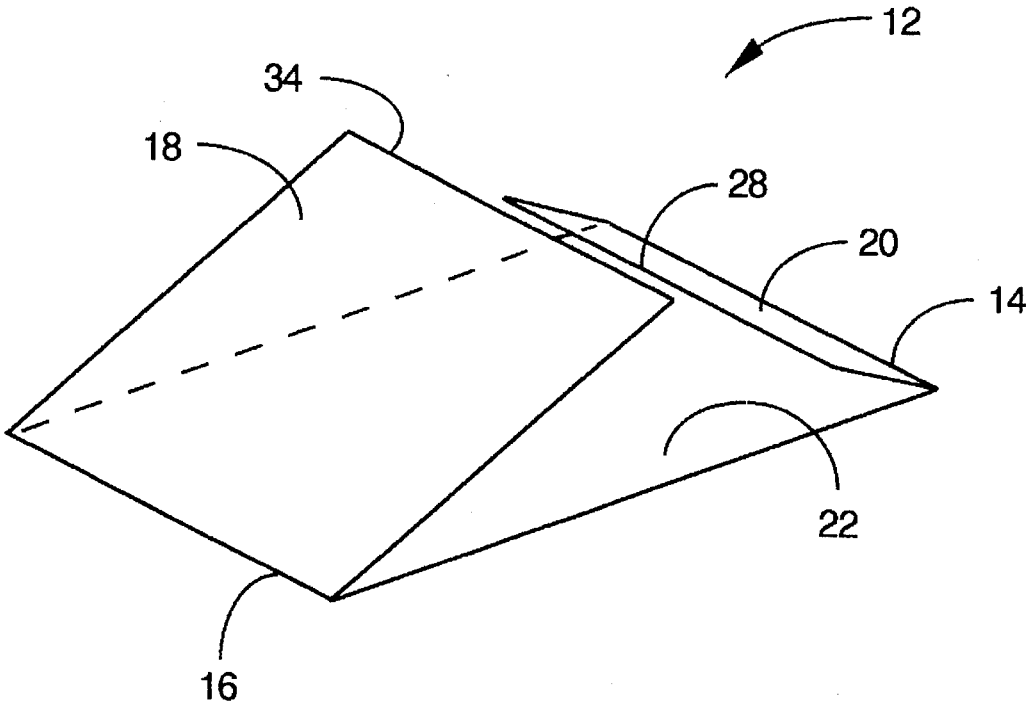
FIG. 1D is an isometric view of a single sheet of material folded along to lines to form a document carrier.
Figure 1E:
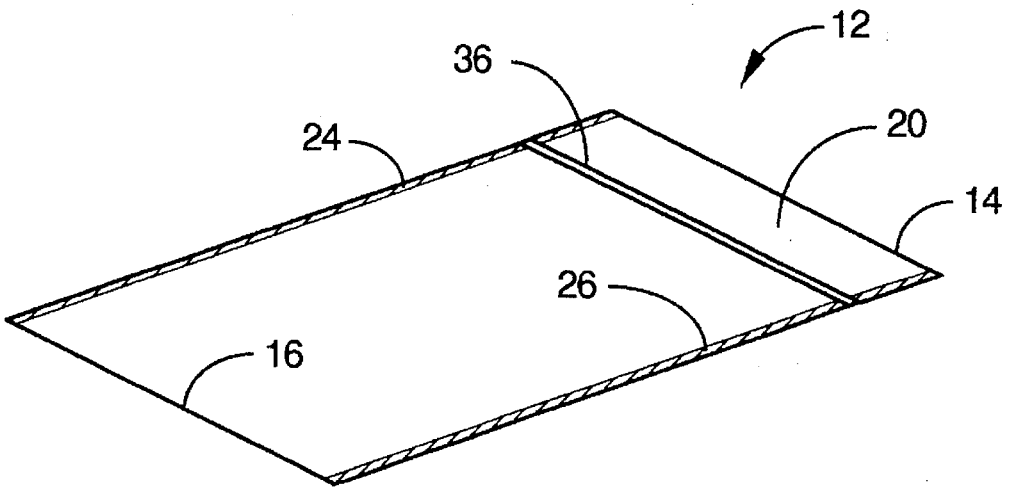
FIG. 1E is an isometric view showing the sheet of FIG. 1D further folded and sealed to form the enclosure of a document carrier.

FIGS. 1D and 1E show another convenient construction technique. FIG. 1D shows a single sheet 12 of plastic folded along two edges 14 and 16 to form three regions 18, 20, and 22. FIG. 1E shows sheet 12 further folded to a flat condition with opposite long edges 24 and 26 heat sealed to close those edges, forming an enclosure. The folds are made in such a manner that the ends 28 and 34 (FIG. 1D) lie adjacent in the flat aspect of FIG. 1E, leaving a slit 36 as a load/unload slit.

A carrier such as the carrier depicted in FIG. 1D and 1E might still be made by drawing material from a roll. Material drawn is cut to an appropriate length, then fed to a folding apparatus and subsequently closed along the two long, open edges. Printing may be done before or after folding. One might make a carrier open at one end by folding a single sheet along one fold line at the halfway point, then closing the long edges, such as by heat sealing or an adhesive. It will be apparent to those with skill in the art that there are other options and variations for cutting, folding, sealing and the like to make document carriers according to various embodiments of the invention.

The transparent document carrier of FIG. 1B might be used as a document carrier, but lacks some desirable characteristics. For example, any document placed in the carrier may be read through the transparent plastic in its entirety, front and back (assuming a single document). Assuming multiple documents, the front of the first document and the back of the last will be exposed.

Figure 2A:
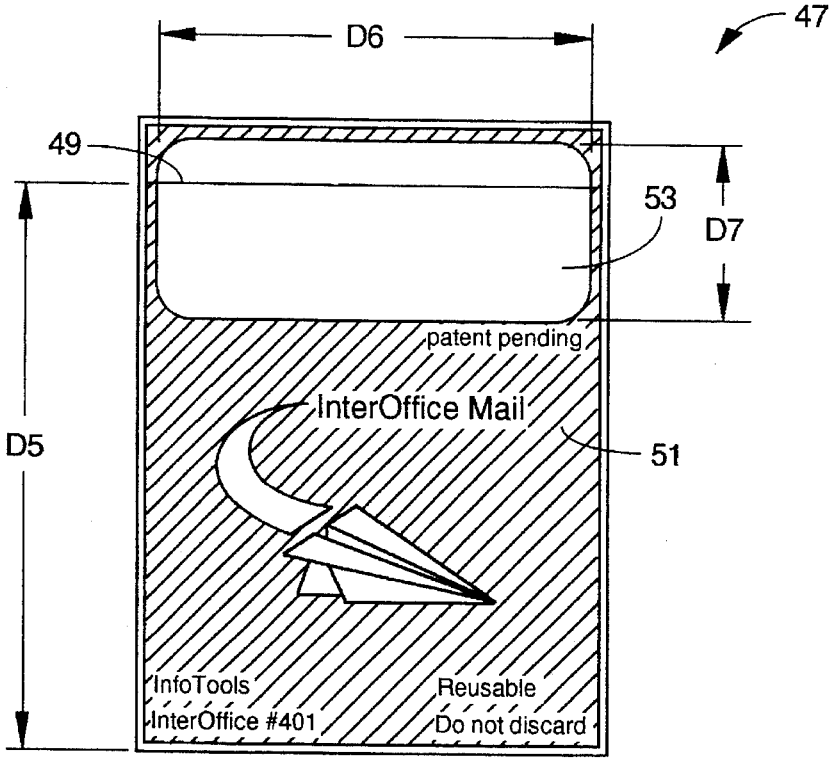
FIG. 2A is a plan view of the load/unload side of a general-purpose inter-office document carrier according to an embodiment of the present invention.

FIG. 2A is a plan view of the load/unload side of a general-purpose inter-office document carrier 47 according to an embodiment of the present invention. Document carrier 47 is the same as document carrier 17 (FIG. 1B), except for a process of printing on both side of the assembled carrier. The front side (shown) is sealed to the back side (not shown) around all four edges, and there is a load/unload slit 49 at a dimension D5 of about 10.75 inches from the lower edge, as indicated above (D3 and D4).

For carrier 47, the front side (shown) is printed to render most of the front side opaque or semi-opaque, indicated by shaded regions 51. Shaded region 51 is provided in a manner to leave a transparent window 53 of dimensions D6 by D7, where D6 is about 6 inches, and D7 is about 3 inches. The purpose of this transparent window is to allow a letterhead or address heading on a document sheet within the carrier to be legible through the front side of the carrier, while still hiding most of the area of a document within the carrier. A transparent border may also be left along the edges as shown. Upon shaded area 51, various indicia may be provided, such as the model designation "InfoTools", the label "Interoffice Mail", and the logo of a paper airplane indicating a message in flight.

The transparent window provides for an addressing system overcoming the drawback of prior art systems wherein spaces are provided on the exterior of the carrier for address and other destination information, limiting the useful life of the carrier. By showing a destination through the window, the life of the carrier of FIG. 2A is not limited so. In the circumstance that a document to be forwarded in such a carrier has no letterhead or address to show through window 49, one may add a tag to the document or to the top document of a group of documents, with the destination information inscribed on the tag, which is then easily removable after the carrier is delivered with the document(s). Such a tag may be one of the well-known adhesive tags, sold under several brand names, or tags mounted in another manner, such as by a staple or a paper clip or other binder. Furthermore, adding the tag to the document and then enclosing the document and the added tag in a carrier according to an embodiment of the present invention, has an inherent advantage over simply adding a tag to a document and forwarding the document, or over adding a tag to the outside of a document carrier. The added tag, by being within a carrier and showing through a transparent window, is protected from being accidently removed or discarded.

Although the size of the window described above with reference to FIG. 2A is a desirable characteristic, it will be evident to one with skill in the art, given the disclosure of the purpose of the window, that the size of the window is not a defining characteristic for the scope of the invention. The window could be smaller or larger, for example, and located differently than shown in FIG. 2A.

Figure 2B:
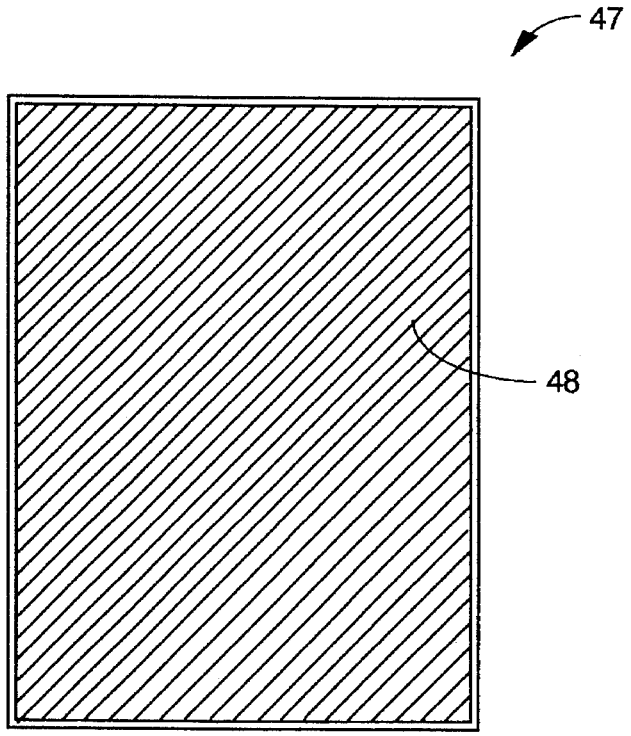
FIG. 2B is a plan view of the side opposite the load/unload side of the inter-office document carrier of FIG. 2A.
Figure 2C:
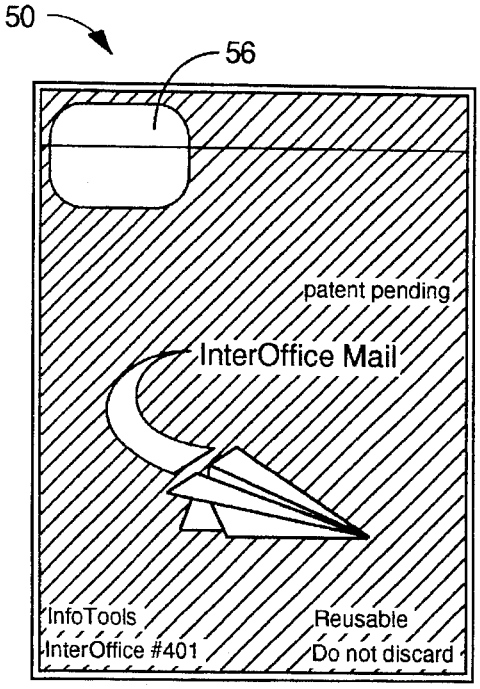
FIG. 2C is a plan view of a document carrier in an alternative embodiment of the present invention.
Figure 2D:
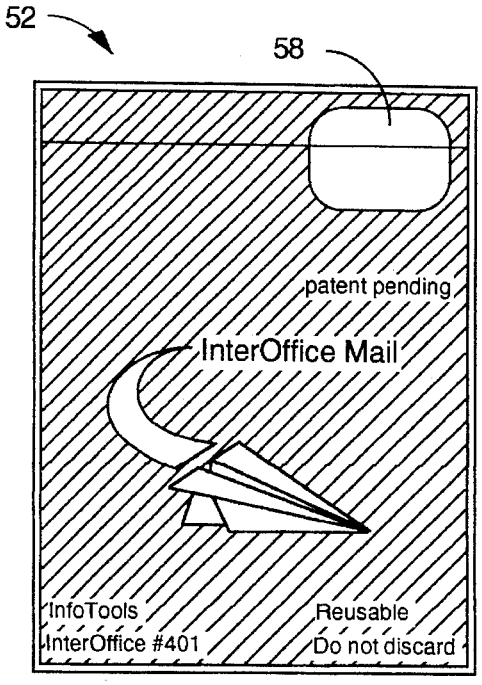
FIG. 2D is a plan view of a document carrier in yet another alternative embodiment of the present invention.
Figure 2E:
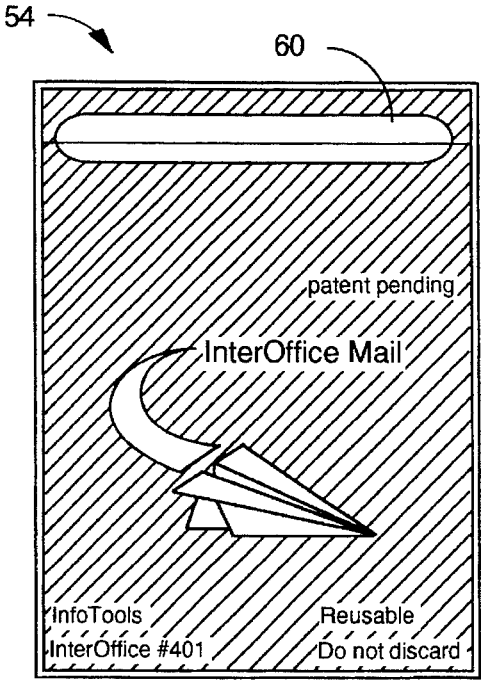
FIG. 2E is a plan view of a document carrier in still another alternative embodiment of the present invention.

FIGS. 2C, 2D, and 2E show carriers 50, 52, and 54 show windows 56, 58, and 60 respectively, having windows of different size and differently located than that shown in FIG. 2A. Window 56 is of the size of a small "post-it" tag, and located where such a tag placed at the upper left of a top sheet of documents loaded into carrier 50 would show through the window. Window 58 is similar, but a tag would be placed at the upper right of a document. Window 60 is substantially full width but narrow, and would serve for a situation wherein full width but, narrow post-it notes would be added as a strip across the top of a document.

FIG. 2B shows the backside of carrier 47 of FIG. 2A, which could also represent the backside of carriers 50, 52, and 54. In this particular embodiment, the backside is printed (shaded area 48) to render substantially all of the backside opaque or semi-opaque. In other, similar embodiments, indicia may be included on the backside as well as on the front side. In an alternative, the load/unload slit, shown as slit 49 in FIG. 2A, could be on the opposite side to the side shown, in which case, the slit would show in FIG. 2B rather than FIG. 2A.

It will be apparent to those with skill in the art that there is a broad difference in selection of indicia that might be printed or otherwise provided on the sides of the interoffice document carrier described, without departing from the scope of the invention.

In a preferred method, printing is accomplished during the construction of the document carriers as shown in FIG. 1C. Printing may be done on the two continuous webs 30 and 32 before the webs are wound on rolls 35 and 37. If one side is blank, as in FIG. 2B, no particular registration problem is created. If both sides are printed with particular indicia, then provision must be made to register or otherwise align the two webs before and during joining. Alternatively, printing may be done after joining the webs, and prior to separating the webs, either before or after the cross seals are made. In this case, registration is not a problem.

Figure 3A:
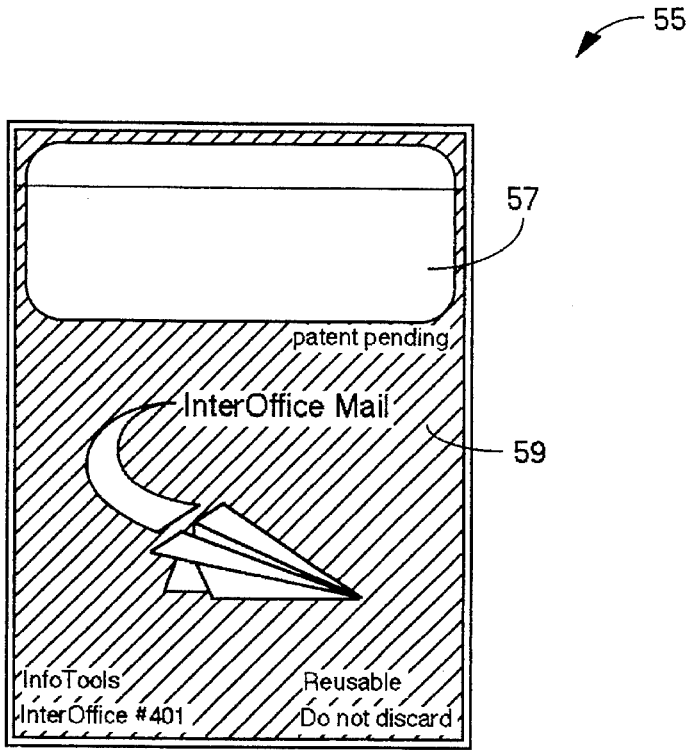
FIG. 3A is a plan view of the load/unload side of another inter-office document carrier according to an embodiment of the invention.

FIG. 3A is a plan view of the front side of an interoffice document carrier 55 according to another embodiment of the present invention. In this embodiment the front, or load/unload side, is the same as in the embodiment shown by FIG. 2A, including a transparent window 57 left in the printing step. Most of the load/unload side, save window 57, is opaque or semi-opaque by virtue of printed area shown by region 59. In this embodiment region 59 is printed in a particular color, such as red.

Figure 3B:
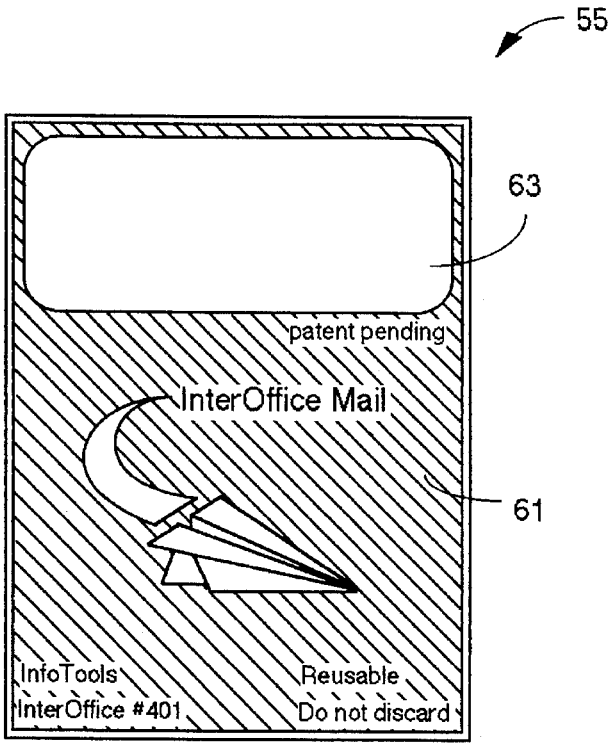
FIG. 3B is a plan view of the side opposite the load/unload side of the inter-office document carrier of FIG. 3A.

FIG. 3B is a plan view of the side of carrier 55 opposite the load/unload side in FIG. 3A. Most of this side is also printed over to be opaque or semi-opaque as indicated by shaded region 61, except a window 63 is left transparent as in the load/unload side shown in FIG. 3A. There may also be indicia as shown, and in a preferred embodiment, the indicia may be the same as on the load/unload side.

An importance difference between the sides shown in FIGS. 3A and 3B is, that while shaded region 59 in FIG. 3A is one color, such as red, shaded region 61 on the opposite side is another color, such as blue.

By having the two sides alike, but in different color, such as red and blue, users may establish protocol and priority for documents and messages sent, wherein the side selected to be the side through which the destination information shows determines a characteristic of the message or documents inside. For example, if one selects to use the red side (hot), that might indicate the document is of considerable urgency, and is to be expedited. Also, the recipient would then know to not delay reading the document(s) contained therein. If one alternatively selects to use the blue side (cool), that might indicate a lower priority or urgency.

It will be apparent to one with skill in the art that the difference in coloration of the opposite sides need not be limited to red and blue, but might encompass a range of alternative colors, or even other indicia, such as crosshatching and the like, to indicate a different characteristic or purpose for document forwarding.

Figure 4A:
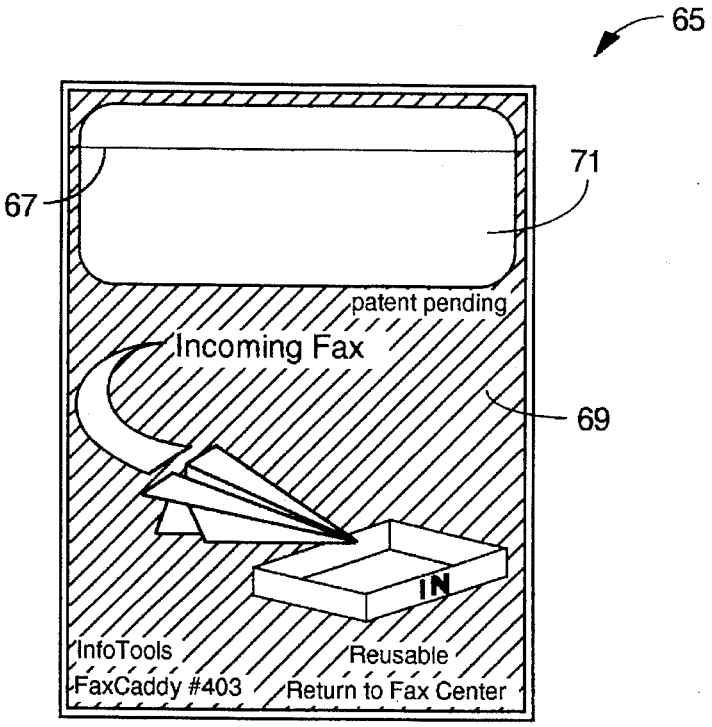
FIG. 4A is a plan view of the load/unload side of a fax carrier according to an embodiment of the present invention.

FIG. 4A is a plan view of the load/unload side of a fax carrier 65 according to an embodiment of the present invention. Fax carrier 65 has a load/unload slit 67, a printed opaque or semi-opaque region 69, a window 71, and indicia as shown indicating that a document or documents forwarded by using this side are outgoing documents, that is, documents destined for a fax facility or department, where the documents are to be removed and used as originals to send facsimile copies to a remote destination. In this embodiment, the opaque region is of a particular color, such as red, which emphasizes the purpose and destination.

Figure 4B:
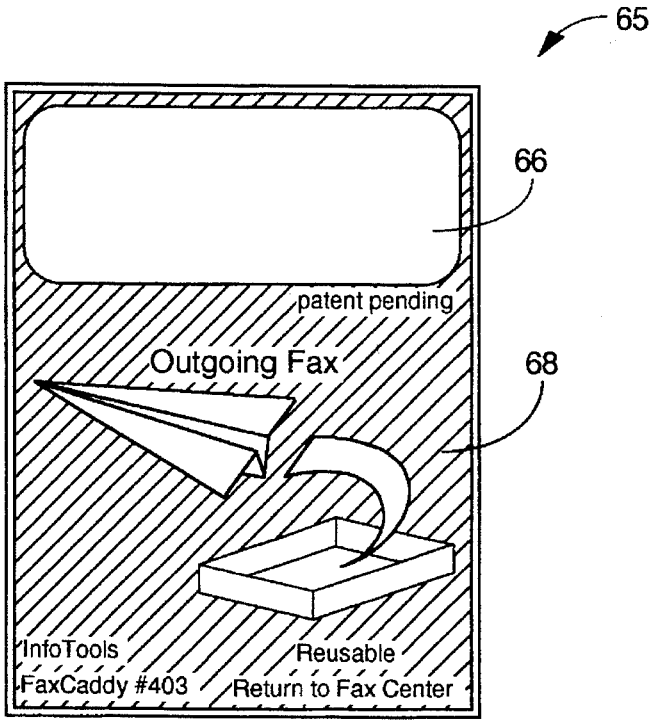
FIG. 4B is a plan view of the side opposite the load/unload side of the fax carrier of FIG. 4A.

FIG. 4B is a plan view of the side opposite the load/unload side of the fax carrier of FIG. 4A. The side shown in FIG. 4B is similar to the load/unload side in opaque printing and indicia, except the indicia indicate the purpose of incoming fax document(s), and has a window 66. Also the color is different from the color of the load/unload side, in this case blue.

Both the indicia and the color of each side indicate to all those involved in moving documents in an organization, that the documents are either incoming or outgoing documents. The incoming side of the carrier may also be used to return originals to a sender in an organization.

Figure 5A:
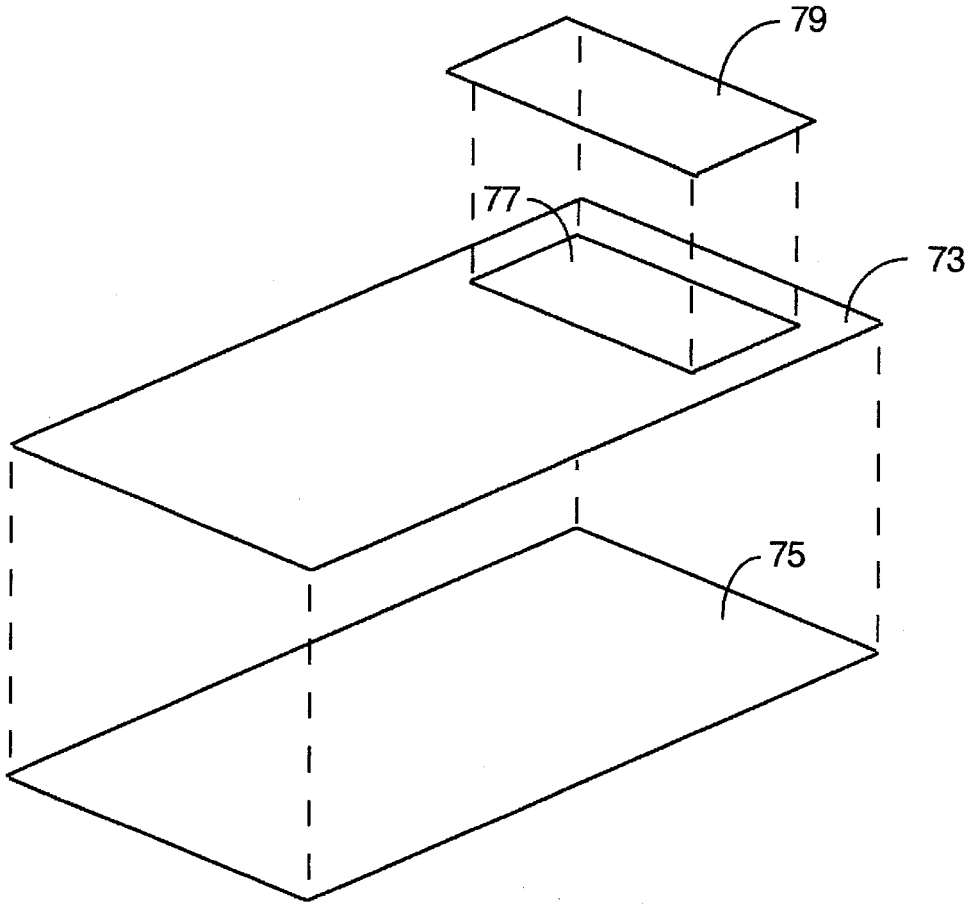
FIG. 5A is an isometric exploded view of construction of a document carrier according to an alternative embodiment of the present invention.

FIG. 5A is an isometric exploded view of construction of a document carrier according to an alternative embodiment of the present invention. In this construction, opaque or semi-opaque plastic, that is, plastic which has a natural color or an added color to make the plastic opaque or semi-opaque rather than transparent, is used for most of the carrier. An opaque front side 73 having an opening 77 for a window is joined to a backside 75 of opaque plastic. A transparent plastic window 79, marginally larger than opening 77, is provided for sealing to opening 77 around all four edges, to provide a transparent window. In this construction it will be apparent that windows of different sizes and locations may be provides, as in other embodiments described above.

Figure 5B:
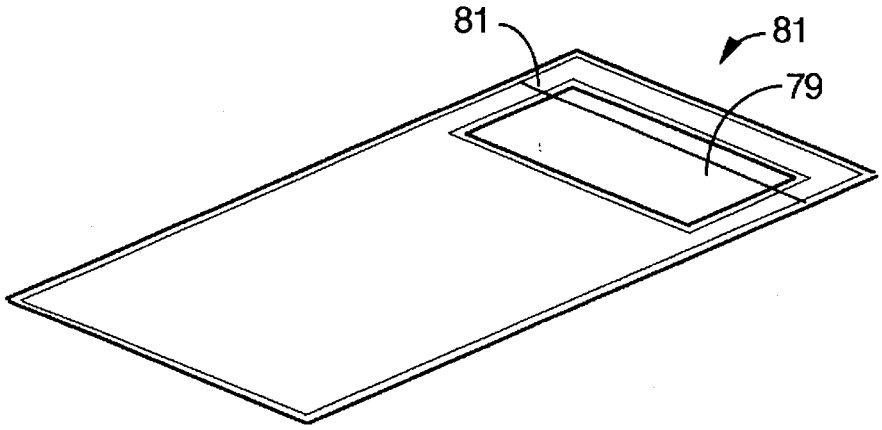
FIG. 5B is an isometric view of a document carrier assembled from the elements of FIG. 5A.

FIG. 5B is an isometric view of a document carrier 81 assembled from the elements of FIG. 5A, showing window 79 sealed in place. A load/unload slit 80 has been added. Indicia may also be printed on one or both sides in this construction, and a window may also be provided in both sides, instead of just the one side as shown, so carriers of all the sorts described in several embodiments above may be provided by the construction technique illustrated by FIGS. 5A and 5B.

Figure 6A:
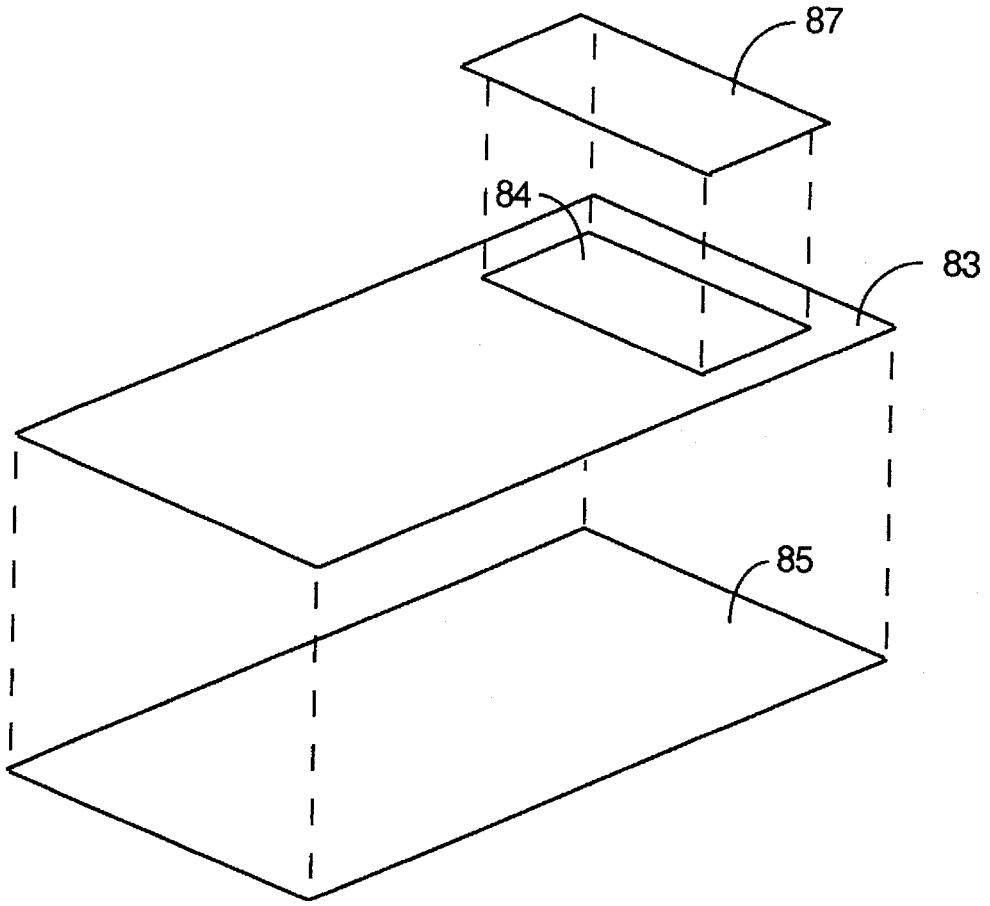
FIG. 6A is an isometric exploded view of construction of a document carrier according to yet another alternative embodiment of the present invention.

FIG. 6A is an isometric exploded view of construction of a document carrier according to yet another alternative embodiment or the present invention. In this embodiment sides 83 and 85 are made of opaque paper, and side 83 has a window cutout 84. A transparent window, which may be of transparent plastic or other transparent material, is provided marginally larger than opening 84 to provide a window in assembly.

Figure 6B:
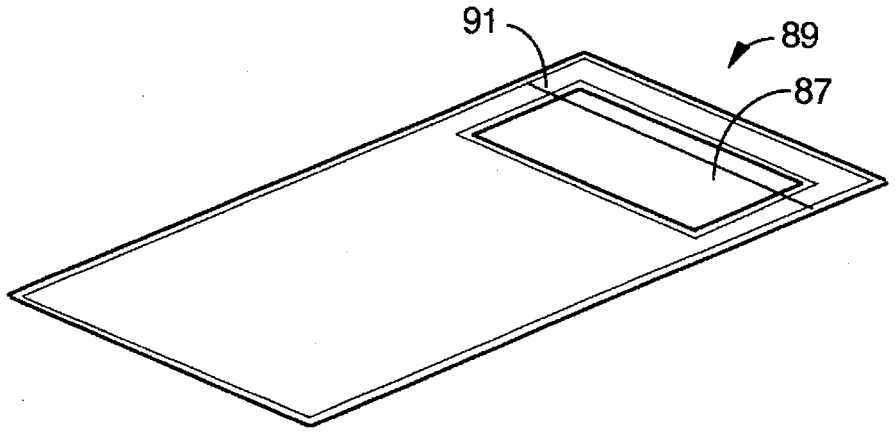
FIG. 6B is all isometric view of a document carrier assembled from the elements of FIG. 6A.

FIG. 6B is an isometric view of a document carrier 89 assembled from the elements of FIG. 6A. In this case the parts are assembled by means of added adhesive (not shown) along the edges and around the window openings. Window 87 is shown in place, and a load/unload slit 91 has been added. In this case, as in the construction shown by FIGS. 5A and 5B, there may be windows on one or both sides, and there may be printed indicia on one or both sides.

It will be apparent to those with skill in the art that there are a variety of changes that might be made in the embodiments described without departing from the spirit and scope of the present invention. Many such alternatives have already been described. For example, the dimensions of finished document carriers according to the invention may be controlled to provide an optimum size for documents of a particular standard size, such as international A4 or U.S.

legal. Many different sorts of materials may be incorporated, and many sorts of indicia may be used. Also, many joining and adhesive techniques might be employed, and many sequential schemes of assembly and printing might be employed to make document carriers according to the invention. In addition, windows of different sizes and locations may be employed. There are many other difference in detail that might be made without departing from the spirit and scope of the invention.

What is claimed is:

1. A substantially rectangular document carrier of length L and width W, comprising:

a first layer of film; and a second layer of film joined to the first layer along all four edges, forming an enclosure having first and second exposed sides, the second layer having a permanent slit opening across the width W within one third of length L from one closed end;

wherein both the first and second layers are substantially opaque excepting a transparent region through each layer within one third of length L from one closed end, and wherein the first and second exposed sides are distinguished from one another by being of different color.

2. A substantially rectangular document carrier as in claim 1 wherein the two different colors are red and blue.

3. A substantially rectangular document carrier as in claim 1 wherein the transparent regions extend across substantially all of width W.

4. A substantially rectangular document carrier as in claim 1 wherein the permanent slit opening is within one-fourth of length L from the one closed end.

5. A substantially rectangular document carrier as in claim 1 wherein the transparent regions extend substantially the width W, have a height not less than one-eighth and not more than one-third the length L, and are positioned within one third of length L from the one closed end.

6. A substantially rectangular document carrier as in claim 1 wherein the transparent regions extend less than half the width W, have a height not less than one-eighth and not more than one-quarter of the length L, and are positioned within one quarter of length L from the one closed end.

7. A substantially rectangular document carrier as in claim 1 wherein the transparent regions extend substantially the width W, have a height not less than one-eighth and not more than one-third of the length L, and are positioned within one-third of the length L from the one closed end.

8. A substantially rectangular document carrier as in claim 1 wherein the material of the layers is transparent plastic and the opaque quality is added by printing on the film layers, the transparent regions resulting from regions not printed.

9. A substantially rectangular document carrier as in claim 1 wherein the material of the layers is substantially opaque plastic, and the transparent regions are formed by cut-out regions having windows of transparent plastic mounted thereto.

10. A substantially rectangular document carrier as in claim 1 wherein the first and second exposed sides are distinguished from one another by alphanumeric indicia in addition to being of different color.

11. A substantially rectangular document carrier as in claim 10 wherein the alphanumeric indicia on one side includes the legend "Incoming Fax" and the alphanumeric Indicia on the other side includes the words "Outgoing Fax".

12. A substantially rectangular document carrier as in claim 1 including a transparent border along the four edges.

13. A substantially rectangular document carrier as in claim 1 wherein the first and second layers are formed by folding a single film sheet, the fold forming one of the four edges, and joining the other three edges.

14. A substantially rectangular document carrier of length L and width W, comprising:

a first layer of film; and a second layer of film joined to the first layer along all four edges, forming an enclosure having first and second exposed sides, the second layer having a permanent slit opening across the width W within one fourth of length L from one closed end;

wherein both the first and second layers are substantially opaque except for a transparent region through each layer within one third of length L from the one closed end, and a transparent border along the four edges, and wherein the first and second exposed sides are distinguished from one another by the substantially opaque portion of one of the first and second film layers being of a first color, and the substantially opaque portion of the other of the first and second film layers being of a second color, and by alphanumeric legends on the two exposed sides.

15. A substantially rectangular document carrier as in claim 14 wherein the first color is red and the second color is blue.

16. A substantially rectangular document carrier as in claim 14 wherein the legend on one exposed side includes the words "Outgoing Fax", and the legend on the other exposed side includes the words "Incoming Fax".

17. A substantially rectangular document carrier as in claim 16 wherein the first color is red and the second color is blue.

18. A substantially rectangular document carrier as in claim 16 wherein the legend on one exposed side includes the words "Outgoing Fax", and the legend on the other exposed side includes the words "Incoming Fax".

19. A substantially rectangular document carrier of length L and width W, comprising:

a first layer of film; and a second layer of film joined to the first layer along all four edges, forming an enclosure having first and second exposed sides, the second layer having a permanent slit opening across the width W within one fourth of length L from one closed end;

wherein both the first and second layers are substantially opaque except for a transparent region through each layer within one fourth of length L from the one closed end and within one half of width W such that the transparent regions do not overlap, and a transparent border along the four edges, and wherein the first and second exposed sides are distinguished from one another by the substantially opaque portion of one of the first and second film layers being of a first color and the opaque or translucent portion of the other of the first and second film layers being of a second color, and by alphanumeric legends on the two exposed sides.

* * * * *